United States Patent [19]

Preslow

[11] 4,167,145

[45] Sep. 11, 1979

[54] CANTILEVERED SHELF ASSEMBLY

[76] Inventor: Arthur A. Preslow, 1640 E. Edinger-Suite G, Santa Ana, Calif. 92705

[21] Appl. No.: 908,506

[22] Filed: May 22, 1978

[51] Int. Cl.[2] ..... A47B 5/00

[52] U.S. Cl. ..... 108/152; 248/225.1

[58] Field of Search ..... 108/151, 152; 248/220.2, 223.4, 224.3, 224.4, 225.1

[56] References Cited

U.S. PATENT DOCUMENTS

| | | | |
|---|---|---|---|
| 3,527,175 | 4/1968 | Kapnek | 108/152 |
| 3,714,907 | 2/1973 | Michieli | 108/152 |
| 3,718,101 | 2/1973 | Sacks | 108/152 |
| 3,752,088 | 8/1973 | Kapnek | 108/152 |

*Primary Examiner*—James C. Mitchell
*Attorney, Agent, or Firm*—Gary Appel

[57] ABSTRACT

A cantilevered shelf assembly having a shelf with a rectangular mortised opening therein, the opening containing a generally C-shaped clamp member having the free end thereof adjacent the outer perimeter of the opening. A second C-shaped clamp member is secured to a wall or the like with the free ends thereof generally perpendicular to the wall surface for fitting within the opening in overlapping relation with the free ends of the C-shaped members within the opening. The shelf and C-shaped members when assembled have aligned openings for passage therethrough of a pin member for supporting the shelf. For longer shelves, a second similar assembly can be provided.

4 Claims, 6 Drawing Figures

CANTILEVERED SHELF ASSEMBLY

BACKGROUND OF THE INVENTION

The background of the invention will be discussed in two parts:

1. Field of the Invention

The present invention relates to assemblies for connecting a panel in perpendicular relation to a surface and more particularly to a cantilevered shelf assembly.

2. Description of the Prior Art

Enjoining two panels at mutually perpendicular angles, such as mounting a shelf to a wall, conventionally mounting brackets are disposed vertically on the walls in parallel relation for receiving in slots formed therein shelf brackets which support the shelves with the shelf brackets being visible along with the mounting bracket members.

Attempts have been made to conceal the mounting hardware for shelving such as the shelf and mounting assemblies shown in U.S. Pat. Nos. 3,048,279; 3,714,907; 3,718,101; and 3,752,088.

It is an object of the present invention to provide a new and improved shelf mounting assembly.

It is another object of this invention to provide a new and improved cantilevered shelf assembly.

It is a further object of this invention to provide a new and improved shelf assembly having concealed mounting hardware.

SUMMARY OF THE INVENTION

The foregoing and other objects are accomplished by providing a shelf assembly including a shelf having at least one generally rectangular mortised opening therein in one edge thereof. A first C-shaped member is secured within the opening or pocket with the free ends thereof extending outwardly toward the edge of the shelf member. A second C-shaped member has the bight portion thereof secured to the wall for insertion within the pocket with the free ends thereof in abutting aligned relation with the first C-shaped member. A pin is inserted through an adjacent exposed edge of the shelf, the pin extending through aligned openings in the arms of the abutting C-shaped members for securing the shelf to the wall. The C-shaped members may conveniently be formed of angle iron or sheet metal.

Other objects, features and advantages of the invention will become apparent from a reading of the specification when taken in conjunction with the drawings in which like referenced numerals refer to like elements in the several views.

DESCRIPTION OF THE PREFERRED EMBODIMENT

Figure 1:
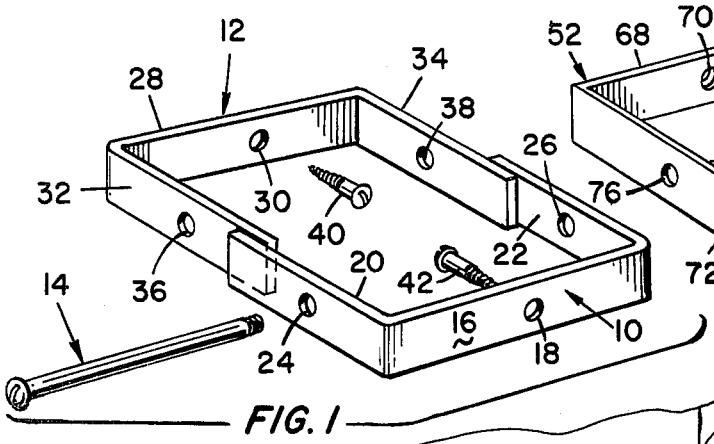
FIG. 1 is a perspective view, partially exploded, of a first embodiment of the shelf mounting hardware according to the invention.

Referring now to the drawings and particuarly to FIG. 1, the mounting hardware for the cantilevered shelf assembly according to the invention includes a first C-shaped mounting member generally designated 10, a second C-shaped mounting member generally designated 12 and a pin 14.

The member 10 has a C-shaped configuration with a bight portion or main body portion 16 with a centrally disposed aperture 18 and generally perpendicular arm portions 20 and 22 respectively, each of the arms 20 and 22 having generally centrally disposed aligned apertures 24 and 26 respectively. Similarly, the member 12 has a main body portion 28 with a centrally disposed aperture 30 formed therein with outwardly extending arm portions 32 and 34, each having apertures 36 and 38 respectively formed therein at the approximate midpoint thereof. The overall outer distance between arm members 32 and 34 of member 12 is approximately the same as or slightly larger than the spacing between inner surfaces of opposing arm members 20 and 22 of member 10 for permitting the two C-shaped members 10 and 12 to be positioned in abutting aligned relation with the arms 32 and 34 of member 12 fitting within the space between arms 20 and 22 of member 10. The overall length of the arms 32 and 34 of member 12 is such that with the apertures 36 and 38 respectively, thereof, in alignment with the apertures 24 and 26 in arms 20 and 22 respectively of member 10, the free edges are in abutting relation with the inner surface of the main body portion 16 of member 10. With the parts so aligned, the pin 14, as will hereinafter be discussed, extends through the shelf member and through the so-aligned apertures for securing the parts in assembled relation in cantilevered fashion. Suitable fastening means such as screws 40 and 42 extend through the apertures 30 and 18 of members 12 and 10 respectively for securing the members to the appropriate surface. In the configuration illustrated in FIG. 1, each of the members 10 and 12 may be formed from scrap iron, angle iron, steel, brass, or any other suitably rigid material.

Figure 2:
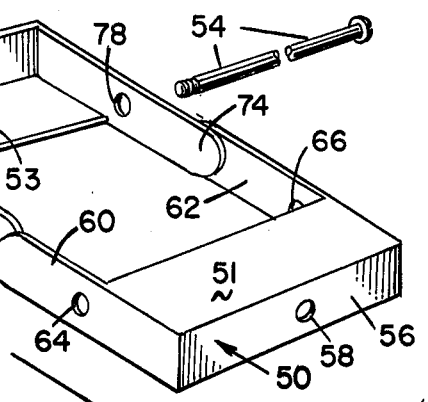
FIG. 2 is a perspective view, partially exploded, illustrating a second embodiment of the mounting hardware according to the invention.

Depicted in FIG. 2 is an alternate embodiment utilizing fabricated sheet metal for the mounting hardware, the mounting assembly including a first member generally designated 50 and a second member generally designated 52, each of the members having a generally C-shaped configuration. Since the sheet metal is somewhat thinner than angle iron, the members 50 and 52 are provided with interconnecting reinforcing plate portions 51 and 53 respectively. A pin 54 is likewise provided for the same purpose as pin 14 in the embodiment of FIG. 1.

The member 50 has a main body portion 56 with a centrally disposed aperture 58 with side arms 60 and 62 respectively interconnected by the plate portion 51 which is secured to each of the side arms 60 and 62 as well as the main body portion 56. Aligned apertures 64 and 66 are likewise formed in arms 60 and 62 respectively.

Similarly, the member 52 has a main body portion 68 with a centrally disposed aperture 70 and a pair of side arms 72 and 74 respectively with apertures 76 and 78 formed therein at the general midpoints thereof. The interconnecting plate portion 53 is secured to the outer edge of arms 72 and 74 respectively as well as the adjacent edge of main body portion 68. The spacing between the outer surfaces of arms 72 and 74 of member 52 is slightly larger than the distance between the inner surfaces of arms 60 and 62 of member 50 to permit the parts to be aligned with the arms thereof in abutting relation with the respective apertures aligned for insertion therethrough of pin 54.

Figure 3:
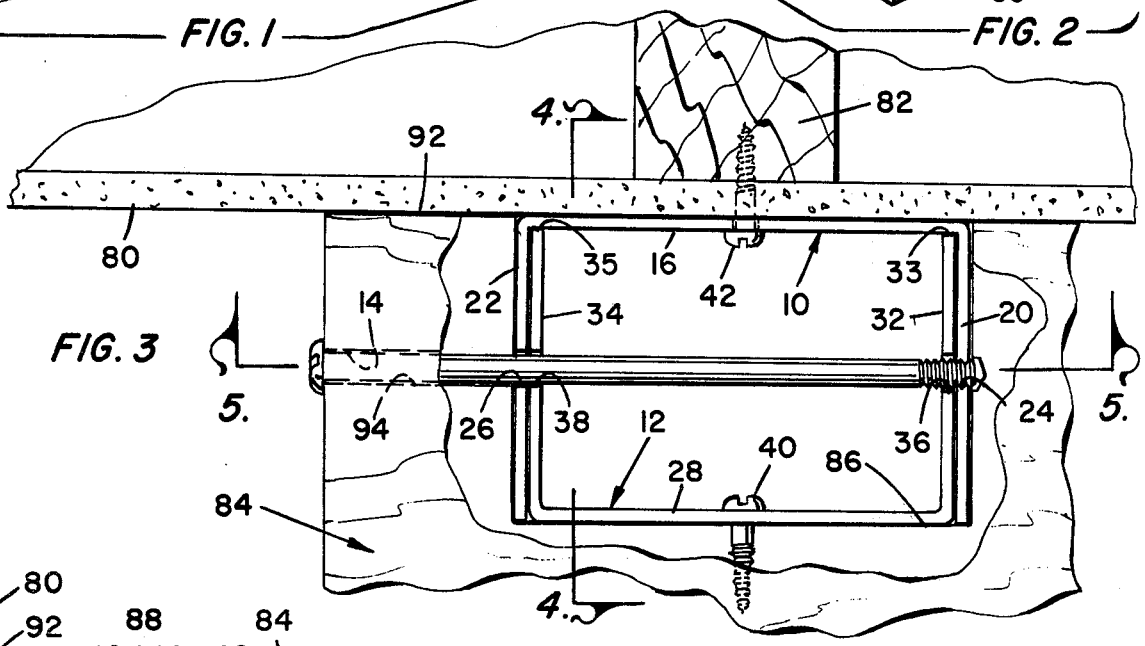
FIG. 3 is a plan view, partially in cross section and partially broken away depicting the cantilevered shelf assembly according to the invention.
Figure 4:
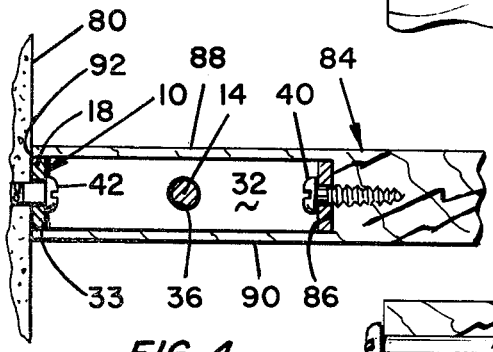
FIG. 4 is a cross sectional view taken generally along line 4—4 of FIG. 3.
Figure 5:
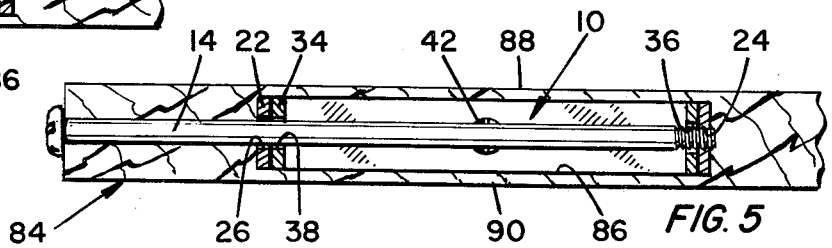
FIG. 5 is a cross sectional view of the assembly taken generally along line 5—5 of FIG. 3.

Referring now to FIGS. 3–6, there is shown a supporting surface 80 which may be a wall or the like, the wall having a layer of plasterboard secured to studs such as stud 82. The stud 82 is suitably located and the member 10 is secured thereto by means of screw 42 extending through the wall 80 and into the stud 82. A shelf 84 has a generally rectangular opening or pocket formed therein, and as illustrated in FIGS. 4 and 5, the pocket 86 is formed such as by mortising so that the upper and lower surfaces 88 and 90 of the shelf 84 remain intact. The inner dimension of the pocket 86 is approximately equal to the height of the members 10 and 12 to permit a snug or close fitting relation within the pocket 86 when assembled. The member 12 is secured within the pocket 86 by screw 40 with the arms 32 and 34 thereof spaced from adjacent edges of the pocket 86 to permit arms 22 and 24 respectively of member 10 to be inserted in the space between the adjacent arm and the adjacent edge or wall of pocket 86. In the assembled relation, as shown in FIG. 3, the long edge 92 of shelf 84 is abutting against the supporting surface 80 with the arms of member 10 and 12 in abutting relation with the apertures therein in general alignment for the insertion of pin 14 through an opening 94 extending longitudinally through the shelf 84 with the pin 14 being generally parallel to the edge 92 of the shelf 84. The pin 14 may optionally be threaded at one end with aperture 24 of arm 20 being suitably threaded for retaining the pin therein. As an alternative, the pin 14 may have a greater length for passing through aperture 24 into an extension of the elongate aperture 94 in alignment therewith on the opposite side of pocket 86. With the shelf 84 thus assembled by means of members 10 and 12, the free ends 33 and 35 of arms 32 and 34 respectively are abutting against the inner surface of the main body portion 16 of member 10 to assist in preventing any turning moment of the shelf assembly about the axis of pin 14.

Referring to FIG. 4 by way of illustration, if a load is placed to the right of the axis of pin 14, with the cantilevered shelf mounting, the force would attempt to rotate the shelf 84 about the axis of pin 14. With the end 33 of arm 32 abutting against the inner surface of the main body portion 16, this would resist the turning moment. Additionally, with the contruction of the alternate embodiment of FIG. 2, the transversely extending plate portions 51 and 53 would abut against the oppositely disposed interconnecting arms of member 50 and 52 respectively to counteract the turning moment and thus provide rigidity to the shelf assembly.

Figure 6:
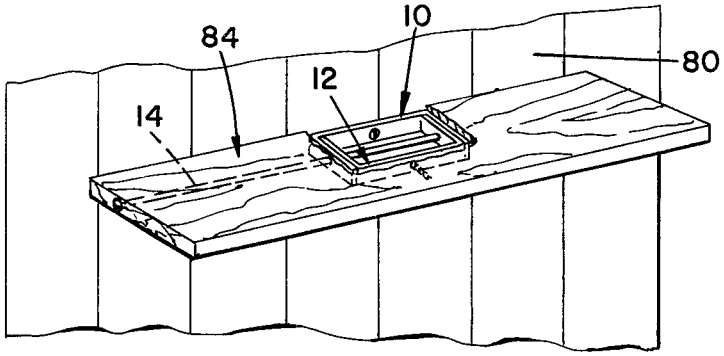
FIG. 6 is a perspective view, partially in cross section and partially broken away, illustrating a shelf in assembled relation with a supporting surface.

FIG. 6 illustrates a shelf 84 secured to a supporting surface 80 by means of the members 10 and 12 and pin 14, only one set of mounting hardware being illustrated, this configuration being acceptable for a short shelf. For longer shelves, two sets of mounting hardware would be utilized, with the sets being adjacent opposite ends of the shelf 84 to provide a two-point spaced supporting structure for the shelf 84.

By means of the cantilevered shelf assembly hereinabove shown and described, shelves 84 can be positioned on a supporting surface 80 without use of unattractive visible mounting hardware. While there has been shown and described a preferred embodiment, it is to be understood that various other adaptations and modifications may be made within the spirit and scope of the invention.

What is claimed is:

1. In a shelf assembly, the combination comprising:

a shelf having a long edge with at least one generally rectangular pocket formed therein;

a first genrally C-shaped clamp member having the bight portion thereof secured within said pocket, and the free end thereof extending toward the open end of said pocket;

a second generally C-shaped member configured for securing the bight portion thereof to a supporting surface with the arms thereof extending into said pocket in abutting aligned relation with the arms of said first C-shaped member;

an aperture in each arm of each of said first and second C-shaped members, said apertures being positioned for general alignment with said first and second C-shaped members in abutting aligned relation;

an aperture within said shelf in general alignment with the so-aligned apertures of said arms; and pin means extending through said shelf aperture and through said arm apertures for securing said first and second C-shaped members to said shelf.

2. The combination according to claim 1 wherein the distance between the outer surfaces of the arms of said second C-shaped member is generally equal to the width of said pocket.

3. The combination according to claim 2 wherein said shelf assembly includes a shelf having two of said pockets, each of said pockets being adjacent an end thereof, and a second set of said first and second C-shaped members and said pin is provided.

4. The combination according to claim 3 wherein said pin member threadably engages at least one of said arms and said shelf aperture.

* * * * *